US006925147B2

(12) United States Patent
Lange et al.

(10) Patent No.: US 6,925,147 B2
(45) Date of Patent: Aug. 2, 2005

(54) X-RAY OPTICAL SYSTEM AND METHOD FOR IMAGING A SOURCE

(75) Inventors: Joachim Lange, Hagenbach (DE); Detlef Bahr, Karlsruhe (DE)

(73) Assignee: Bruker AXS GmbH, Karlsruhe (DE)

( * ) Notice: Subject to any disclaimer, the term of this patent is extended or adjusted under 35 U.S.C. 154(b) by 228 days.

(21) Appl. No.: 10/302,918

(22) Filed: Nov. 25, 2002

(65) Prior Publication Data

US 2003/0108153 A1 Jun. 12, 2003

(30) Foreign Application Priority Data

Dec. 8, 2001 (DE) ..... 101 60 472

(51) Int. Cl.[7] ..... G21K 1/06
(52) U.S. Cl. ..... 378/84; 378/85
(58) Field of Search ..... 378/84, 85, 34, 378/145

(56) References Cited

U.S. PATENT DOCUMENTS 6,014,423 A * 1/2000 Gutman et al. ..... 378/85
6,041,099 A 3/2000 Gutman
6,167,111 A * 12/2000 Watanabe et al. ..... 378/34
6,195,410 B1 * 2/2001 Cash, Jr. ..... 378/43
6,226,349 B1 * 5/2001 Schuster et al. ..... 378/84
6,249,566 B1 * 6/2001 Hayashi et al. ..... 378/85
6,327,335 B1 * 12/2001 Carroll ..... 378/85
6,606,371 B2 * 8/2003 Antonell et al. ..... 378/84

OTHER PUBLICATIONS

"Formation of Optical Images by X–rays", Kirkpatrick and Baez, J. Opt. Soc. Am. 38, No. 9, 1948.
"X–Ray Microscope With Multilayer Mirrors", Underwood et al., Applied Optics 25, No. 11, 1986.

* cited by examiner

*Primary Examiner*—Edward J. Glick
*Assistant Examiner*—Elizabeth Keaney
(74) *Attorney, Agent, or Firm*—Paul Vincent

(57) ABSTRACT

An X-ray optical system with two X-ray mirrors (A,B) for imaging an X-ray source (S) on a target region is characterized in that the X-ray mirrors (A,B) are mutually tilted by an angle other than 90° such that the combined region of acceptance of the X-ray mirror (A,B) is adjusted to the shape of the X-ray source (S) and/or the target region. This increases the intensity of the focused X-ray radiation on the sample for a given emission of the X-ray source (S) power using a few, technically simple modifications.

20 Claims, 4 Drawing Sheets

X-RAY OPTICAL SYSTEM AND METHOD FOR IMAGING A SOURCE

This application claims Paris Convention priority of DE 101 60 472.6 filed Dec. 8, 2001 the complete disclosure of which is hereby incorporated by reference.

BACKGROUND OF THE INVENTION

The invention concerns an X-ray optical system with two X-ray mirrors for imaging an X-ray source on a target region.

A system and method of this type is known from Paul Kirkpatrick and A. V. Baez, J. Opt. Soc. Am. 38, 9 (1948).

The above-mentioned article describes in detail the principal function of an arrangement of this type. It comprises two concave X-ray mirrors which are disposed one behind the other such that the plane of reflection of the first mirror is perpendicular to the plane of reflection of the second mirror. The X-ray radiation which is incident on the first mirror at a very flat angle, is focused in a first coordinate direction and is incident on the second mirror at a likewise flat angle where it is focused in a second coordinate direction perpendicular to the first coordinate direction. In this manner, one obtains X-ray radiation which is focused in two coordinate directions with the ray divergences being at least partially corrected.

The two concave X-ray mirrors may have cylindrical, elliptical or parabolic, curved surfaces. In particular, the use of parabolic mirrors also permits rendering the incident X-ray radiation parallel.

A disadvantage of this conventional Kirkpatrick-Baez arrangement is the considerably limited region of acceptance of the two mirrors. Due to the fact that the Bragg condition must be met for both mirrors, only a surface is imaged which is considerably smaller than the visible radiating overall surface of the X-ray source (approximately 1/100).

U.S. Pat. No. 6,041,099 proposes an improvement to the Kirkpatrick-Baez arrangement, i.e. a one-piece mirror with two reflecting surfaces disposed at 90° with respect to each other (referred to as a "side-by-side" arrangement). This arrangement is intended to approximately double the reflected intensity of the incident X-ray radiation. The configuration is more compact than the classical Kirkpatrick-Baez arrangement having two mirrors disposed in series.

The use of multi-layer mirrors in connection with a Kirkpatrick-Baez arrangement is described in an article by J. Underwood in Applied Optics, Vol. 25, No. 11 (1986).

To give an impression of the magnitudes of the quantities of interest, it should be noted that the angle of acceptance of typical multi-layer mirrors is in the region of 1 mrad and typical foci in the region of a few centimeters. The electron focus of the X-ray source varies in a linear region between 10 $\mu$m and a few millimeters. The angle of acceptance of one mirror has a minimum linear dimension in the region of a few 10 $\mu$m and is typically striped. On the other hand, conventional X-ray samples have linear extensions in the region of 100 $\mu$m to a few millimeters, typically several tenths of a millimeter.

A problem of X-ray optical systems of this type is the relatively low intensity reflected by the mirror arrangement due to the Bragg condition of the focused X-ray radiation, compared to the theoretically possible yield given by the size of the radiating surface of the X-ray source. Moreover, due to the surface size of the sample to be examined, an increased X-ray radiation yield is desirable.

In view of the above, it is the underlying purpose of the present invention to present an X-ray optical system with the above-mentioned features which increases the intensity of the focused X-ray radiation on the sample for a given X-ray source emission power and with as few, technically simple modifications as possible.

SUMMARY OF THE INVENTION

This object is achieved in accordance with the invention in a surprisingly simple and also effective fashion in that the X-ray mirrors are disposed mutually tilted by an angle differing from 90° such that the combined region of acceptance of the X-ray mirror is adapted to the shape of the X-ray source and/or of the target region.

This optimally adjusts the combined region of acceptance of the two mirrors to the geometric shape of the electron focus and/or the sample such that the yield of useful X-ray radiation on the sample is significantly increased. This is particularly advantageous when the two regions are of the same order of magnitude.

In accordance with a further aspect of the invention, the above object is also achieved in that the X-ray mirrors are disposed mutually tilted by other than 90° with a deviation from a 90° tilt angle of at least 20°, preferably between 30° and 85°. This permits adjustment of the combined region of acceptance of the two mirrors to the geometric shape of the electron focus and/or the sample.

Even when the combined region of acceptance of the X-ray mirrors is considerably smaller than the electron focus and/or the sample, the inventive tilt of the X-ray mirrors considerably increases the intensity, since the combined region of acceptance can be considerably enlarged compared to the conventional case of a 90° arrangement (as shown in the drawing below). The region of acceptance is, however, confined by the electron focus of the source and the target focus of the sample.

The invention is advantageous not only in the field of X-ray optics but also in the field of neutron optics and can also be used as a source for synchrotron radiation.

The mirrors may be flat, cylindrical, spherical, elliptical, parabolic or hyperbolic. Graded mirrors can be used with the layer separation varying laterally and/or in depth. Monocrystals or other X-ray optical or neutron optical elements can also be used as mirrors.

In one particularly preferred embodiment of the inventive X-ray optical system, the at least one X-ray mirror has a multi-layer structure to produce a particularly large intensity of the reflected radiation.

In simple embodiments of the invention, the tilt angle of the two X-ray mirrors is fixed which permits "retention" of a previously set optical adjustment in a particular geometry.

In alternative embodiments, the tilt angle may vary to permit setting of various different geometries for the overall arrangement.

In a further development of this embodiment, the X-ray mirrors can be locked in a plurality of discrete tilt positions. In this fashion, predetermined geometries for certain situations can be pre-selected with the respective individual adjustment not requiring great alignment effort due to the discrete locking positions.

The X-ray mirrors can also be designed such that they can be continuously tilted with respect to one another which realizes a completely free on-line optimization tailored for the special requirements of completely different investigations.

In the inventive arrangement, the imaged source area is generally larger, the larger the mutual tilt of the two X-ray mirrors. In advantageous embodiments of the invention, the tilt angle deviation from 90° is at least 3°, preferably at least 10°, particularly preferred between 30° and 85°.

In a particularly simple embodiment of the inventive arrangement, precisely two X-ray mirrors (or neutron mirrors) are provided.

In a further preferred embodiment of the invention, the X-ray mirrors form a mutually tilted Kirkpatrick-Baez arrangement whose conventional version, without tilting, has been used for many decades.

In a further development of this embodiment, the X-ray mirrors may form a mutually tilted side-by-side arrangement as is described, without tilting, in the above-cited U.S. Pat. No. 6,041,099.

In alternative embodiments of the invention, the X-ray mirrors may form a mutually tilted multiple corner arrangement. A non-tilted multiple corner arrangement is known per se e.g. from U.S. Pat. No. 6,014,423. The condition for deviation of the tilt angle from 90° according to the above-discussed further aspect of the invention is to be observed for respective pairs of neighboring X-ray mirrors.

An X-ray spectrometer, an X-ray diffractometer, and an X-ray microscope are also within the scope of the present invention, each having an X-ray optical system of the above-described inventive type.

Also within the scope of the present invention is a method for imaging a radiative source, for X-ray or neutron radiation, onto a target region, wherein the radiation emitted by the source is initially reflected by a first X-ray or neutron mirror and then by a second mirror, wherein the angle between the plane of the first reflection and the plane of the second reflection is tilted sufficiently different from 90° such that the combined region of acceptance of the first and second reflection is adjusted to the shape of the radiation source and/or target region.

This also achieves the above-mentioned object of the invention.

One variant of the inventive method is particularly preferred with which the tilt angle between the plane of the first reflection and the plane of the second reflection is readjusted at least one time during data acquisition (Scan). In this manner, e.g. the sample can be irradiated and scanned at different angles, with optimum adjustment of each individual acquisition step of the scan through corresponding adjustment of the tilt angle.

Further advantages of the invention can be extracted from the description and the drawing. The features mentioned above and below can be used in accordance with the invention either individually or collectively in any arbitrary combination. The embodiments shown and described are not to be understood as exhaustive enumeration, rather have exemplary character for describing the invention.

The invention is shown in the drawing and is further explained by means of embodiments.

DESCRIPTION OF THE PREFERRED EMBODIMENT

Figure 1:
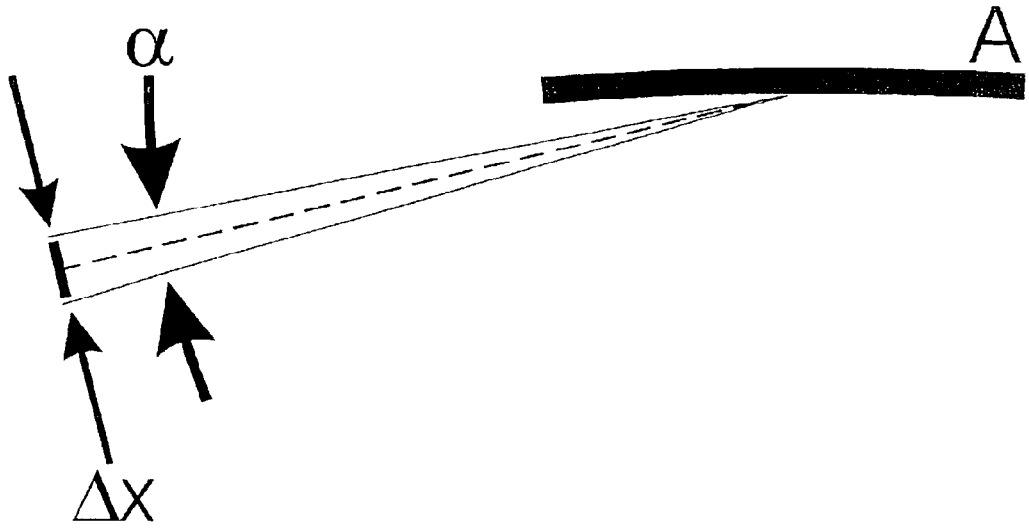
FIG. 1 shows a schematic illustration of the region of acceptance of useful radiation from an X-ray source in the focus of an X-ray mirror.

FIG. 1 schematically shows a cross-section through an X-ray mirror A. Radiation from a region of acceptance Δx in the focus of the mirror A coming from an X-ray source, which is also usually disposed in this focus, is incident on mirror A. The angle of acceptance for the useful radiation reflected by the X-ray mirror under observation of the Bragg condition is designated as α in the drawing.

Figure 2A:
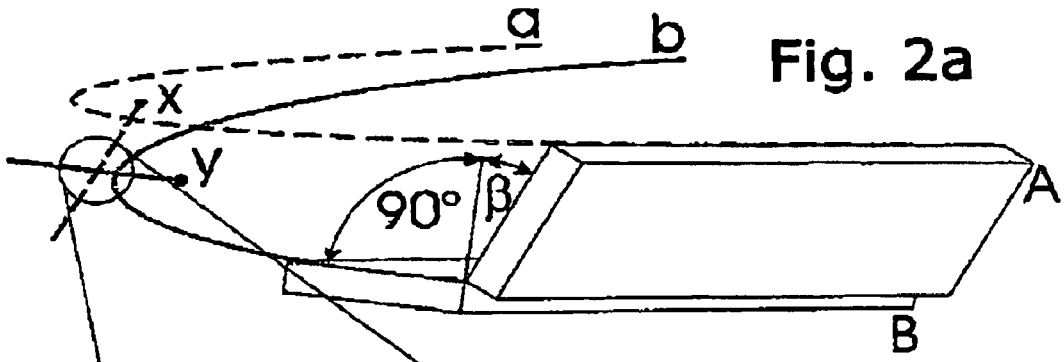
FIG. 2*a* schematically shows a construction of an embodiment of the inventive X-ray optical system.

FIG. 2*a* shows a highly schematic embodiment of an inventive arrangement wherein two X-ray mirrors A, B are mutually tilted by an angle other than 90°. In this embodiment, the two X-ray mirrors A, B each have one parabolic or elliptic surface whose radius of curvature follows the broken or dotted line a (for mirror A) and b (for mirror B), respectively. The focus of the first X-ray mirror A is designated as x and the focus of the second X-ray mirror B is designated as y.

Figure 2B:
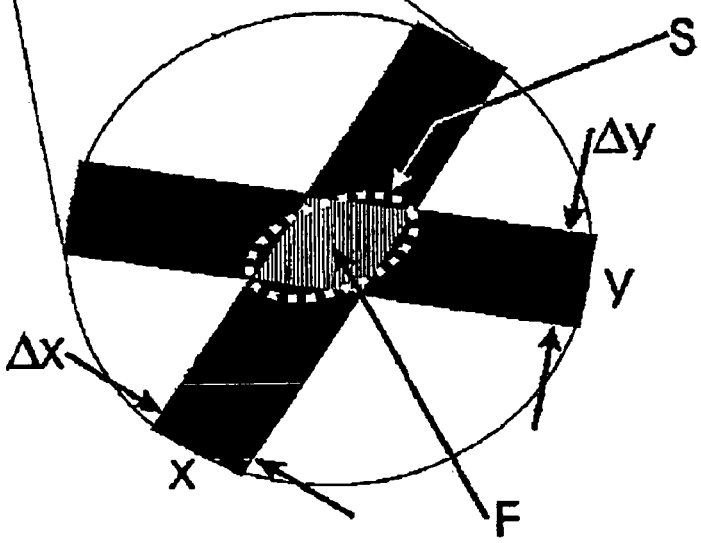
FIG. 2*b* shows an enlarged section of the radiative relationships in the focus of FIG. 2*a;*

FIG. 2*b* shows an enlarged section of FIG. 2*a* wherein Δx is the region of acceptance of the X-ray source, viewed from the X-ray mirror A, and Δy is the region of acceptance of the X-ray source, viewed from the X-ray mirror B. The surface F is the intersection of both regions of acceptance Δx and Δy. In this example, the dotted white ellipse S represents a conventional form of an X-ray source.

Figure 3:
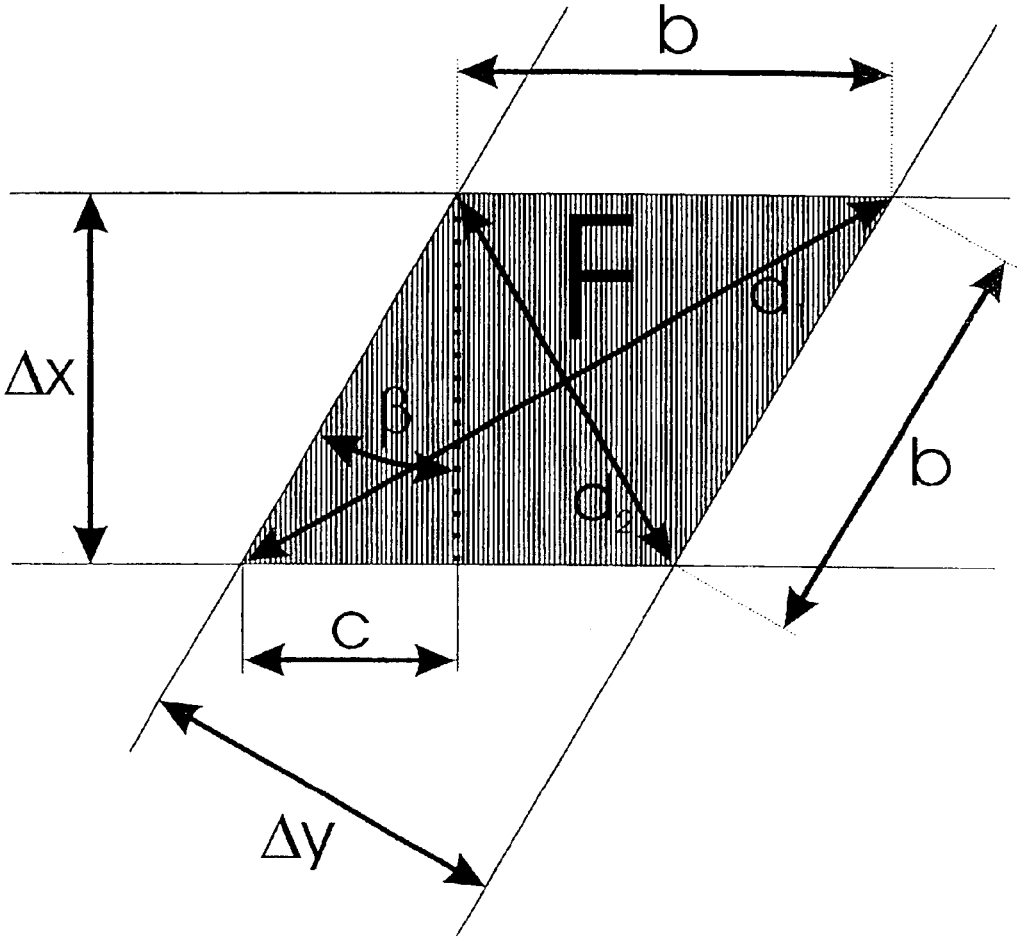
FIG. 3 shows the effective surface as an intersection of the region of acceptance of the two mirrors of FIG. 2*b*.

FIG. 3 schematically shows the distribution of the effective surface F as the intersection of the two regions of acceptance Δx and Δy of the two X-ray mirrors A, B at the location of the X-ray source. The resulting parallelogram has a side length b, a long diagonal $d_1$ and a short diagonal $d_2$. Moreover, the drawing shows the tilt deviation angle β of the two X-ray mirrors A, B from 90°.

The following geometrical relationships obtain between the quantities shown in FIG. 3:

$\Delta x=\Delta y=a$ (for identical X-ray mirrors A, B)

Figure 4:
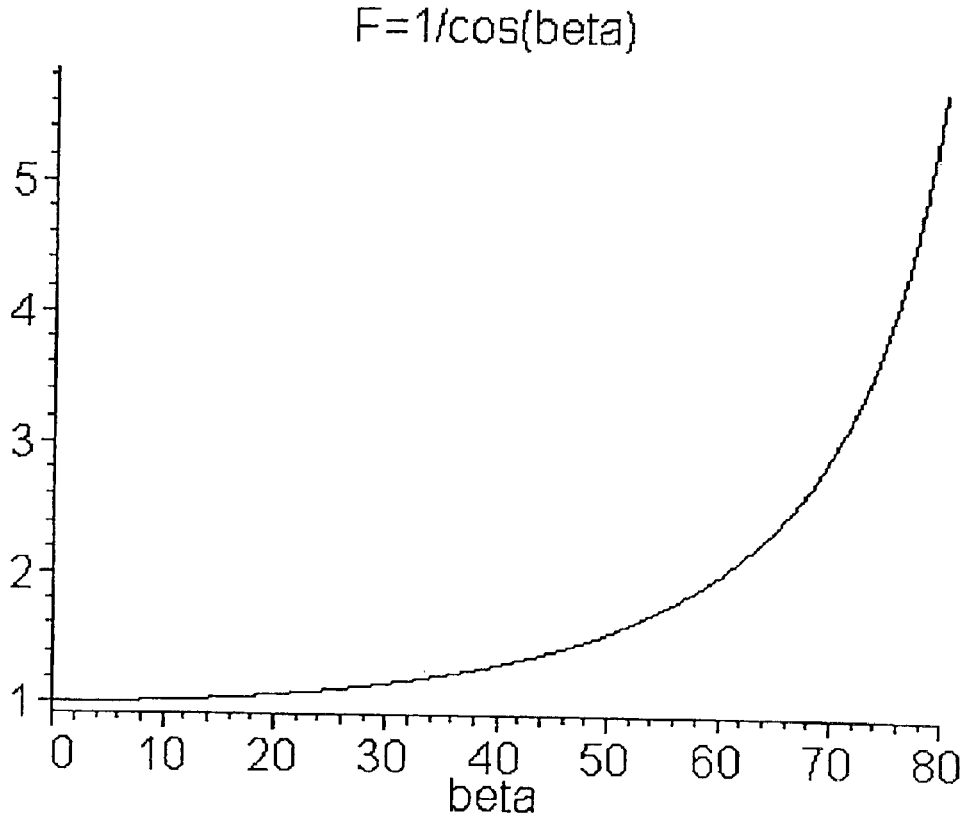
FIG. 4 shows the effective surface F as function of β, the tilt angle deviation from 90°.

$b=\Delta x/\cos\beta=a/\cos\beta$ $F=\Delta x b=a^2/\cos\beta$ $d_1=a((1+\sin\beta)^2/\cos^2\beta+1)^{1/2}$ $C=a\tan\beta$ FIG. 4 shows the surface F (FIG. 3) as a function of the increasing angular deviation β from 90°, wherein the two regions of acceptance Δx and Δy are identical and are normalized to 1.

We claim:

1. An X-ray optical system comprising:

an X-ray source;

an X-ray target region;

a first X-ray mirror for imaging X-rays from said source onto said target region; and a second X-ray mirror for imaging X-rays from said source onto said target region, said second X-ray mirror tilted by an angle, with respect to said first X-ray mirror, which is not equal to 90°, wherein said first and said second X-ray mirrors have a combined diamond-shaped acceptance in a plane substantially perpendicular to a direction of propagation of the X-rays.

2. The X-ray optical system of claim 1, wherein said X-ray source has a source shape and said X-ray target region has a target region shape, wherein said angle is selected such that said combined diamond-shaped acceptance of said first and said second X-ray mirror is adjusted to at least one of said source shape and said target region shape.

3. The X-ray optical system of claim 1, wherein said angle differs from 90° by an amount $\beta \geqq 20°$.

4. The X-ray optical system of claim 1, wherein said angle differs from 90° by an amount $\beta$, wherein $30° \leqq \beta \leqq 85°$.

5. The X-ray optical system of claim 1, wherein at least one of said first and said second X-ray mirror has a multilayer structure.

6. The X-ray optical system of claim 1, wherein said angle is fixed.

7. The X-ray optical system of claim 1, wherein said angle can be varied.

8. The X-ray optical system of claim 7, wherein at least one of said first and said second X-ray mirror can be locked in different discrete tilt positions.

9. The X-ray optical system of claim 7, wherein at least one of said first and said second X-ray mirror can be continuously tilted.

10. The X-ray optical system of claim 1, wherein said angle differs from 90° by an amount $\beta \geqq 3°$.

11. The X-ray optical system of claim 10, wherein $\beta \geqq 10°$.

12. The X-ray optical system of claim 11, wherein $30° \leqq \beta \leqq 85°$.

13. The X-ray optical system of claim 1, wherein precisely two X-ray mirrors are provided.

14. The X-ray optical system of claim 1, wherein said first and said second X-ray mirror form a mutually tilted Kirkpatrick-Baez arrangement.

15. The X-ray optical system of claim 1, wherein said first and said second X-ray mirror form a mutually tilted side-by-side arrangement.

16. An X-ray spectrometer comprising the X-ray optical system of claim 1.

17. An X-ray optical diffractometer comprising the X-ray optical system of claim 1.

18. An X-ray microscope comprising the X-ray optical system of claim 1.

19. A method for imaging a radiation source of X-ray or neutron radiation onto a target region, the method comprising the steps of:

a) reflecting radiation from the source using a first reflector;

b) imaging radiation from the source via said first reflector onto the target region using a second reflector; and c) adjusting an angle between a first reflection plane of said first reflector and a second reflection plane of said second reflector to be sufficiently different from 90° that a combined region of acceptance of said first reflector and said second reflector is diamond-shaped in a plane substantially perpendicular to a direction of propagation of the radiation and is adjusted to at least one of a shape of said radiation source and a shape of said target region.

20. The method of claim 19, wherein said angle between said first reflection plane of said second reflection plane is readjusted at least once during a data acquisition sequence to create a scan.

* * * * *